United States Patent [19]

Collin

[11] 4,272,666

[45] Jun. 9, 1981

[54] FUSING ROLLS FIXING UNIT FOR COPYING MACHINE

[75] Inventor: Vittorino Collin, Turin, Italy

[73] Assignee: Ing. C. Olivetti & C., S.p.A., Ivrea, Italy

[21] Appl. No.: 964,358

[22] Filed: Nov. 28, 1978

[30] Foreign Application Priority Data

Dec. 1, 1977 [IT] Italy ..... 69709 A/77

[51] Int. Cl.[3] ..... H05B 1/00

[52] U.S. Cl. ..... 219/216; 118/60; 355/3 FU; 432/60

[58] Field of Search ..... 355/3 R, 3 FU; 118/59, 118/60; 432/60, 228; 219/216

[56] References Cited

U.S. PATENT DOCUMENTS

| | | | |
|---|---|---|---|
| 3,463,082 | 8/1969 | Kauffer | 101/425 X |
| 4,009,953 | 3/1977 | Ravizza et al. | 355/3 FU |
| 4,038,026 | 7/1977 | Wada et al. | 432/228 X |
| 4,045,165 | 8/1977 | Nokajima et al. | 432/60 |
| 4,079,227 | 3/1978 | Takiguchi | 432/60 X |
| 4,079,229 | 3/1978 | Takiguchi | 432/60 X |

*Primary Examiner*—Fred L. Braun
*Attorney, Agent, or Firm*—W. R. Hulbert

[57] ABSTRACT

A fusing rolls fixing unit having a toner antisticky liquid supply device wetting the surface of the fixing rolls to prevent adhesion of toner particles thereto. The antisticky liquid supply device is discontinuously operated for applying liquid to the fixing rolls only one time for each copy-run executed.

8 Claims, 1 Drawing Figure

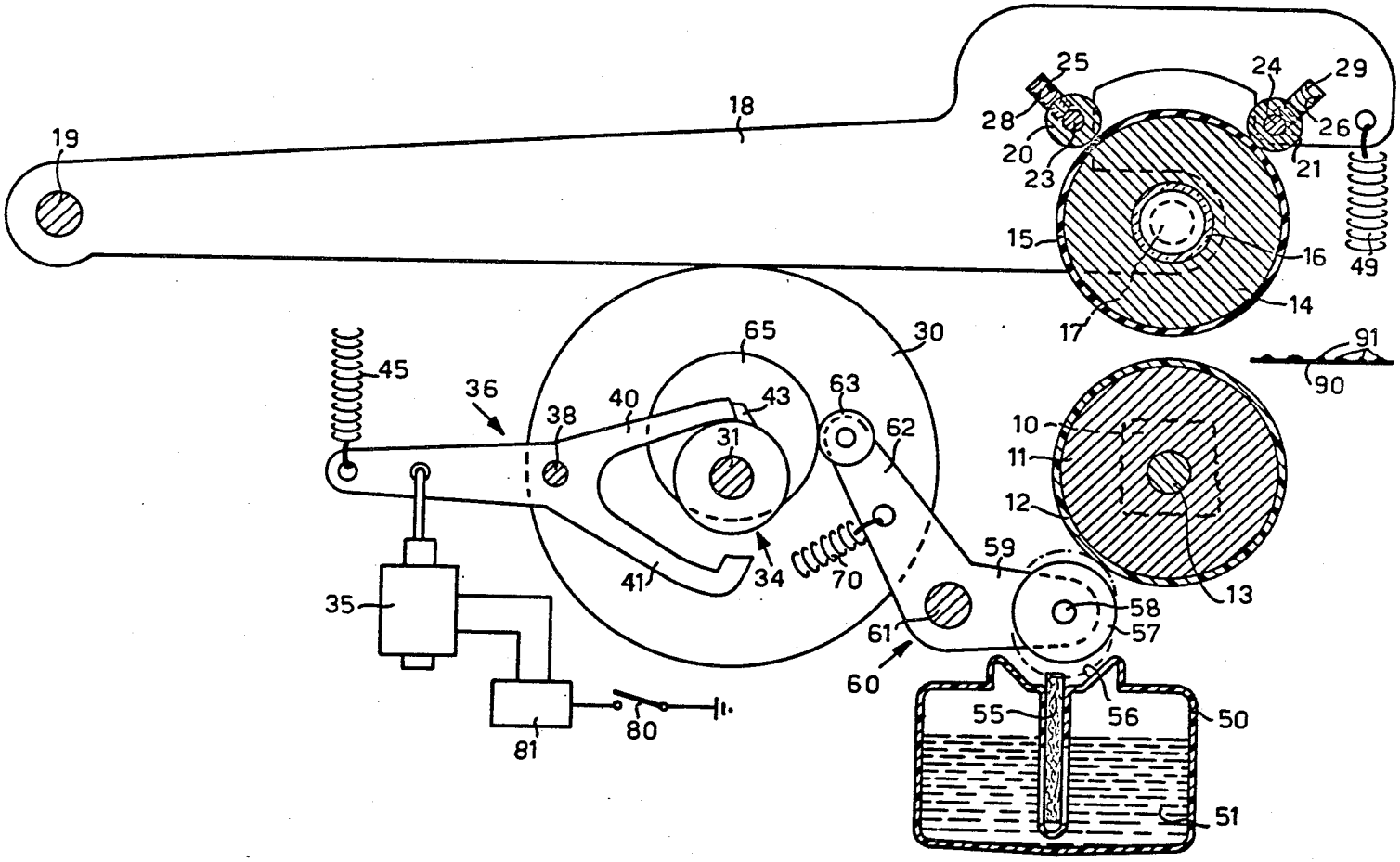
29
26
49
91
90
24
21
16
14
13
50
51
25
28
20
23
15
17
10
11
12
58
57
56
55
59
30
62
61
60
63
70
65
43
31
34
18
40
41
80
38
81
36
45
35
19

FUSING ROLLS FIXING UNIT FOR COPYING MACHINE

BACKGROUND OF THE INVENTION

The present invention refers to a heat fixing unit for an electrophotographic copying machine of the type in which a copy-sheet, having an unfixed toner image on one side thereof, is advanced between two cooperatively rotated rolls while pressure is applied therebetween and, at least the roll in contact with the toned side of the sheet, is heated to a temperature suitable to fix toner to the sheet.

A drawback of the fixing units of the above type is due to sticking of toner particles, carried out from the sheet, to the surface of the rolls; which particles may successively adhere to a following copy-sheet advanced between the rolls so forming thereon undesired toned images or tracks.

This drawback is known as "offset phenomena" and can be obviated by coating the surface of the rolls with suitable antisticky, heat resistant parting material such as tetrafluoroethylene, sold under the trademark Teflon, or silicone rubber, and by wetting the coated surface of the rolls with antisticky or parting liquid, such as silicone oil.

Fixing units are known in which the silicone oil is continuously applied to the fusing rolls by a dispensing roll rotated in contact with a fusing roll and partially immersed in a silicone oil tank.

This last type of toner antisticky liquid supply device has the drawback of causing an unnecessary high consumption of silicone oil and also, due to the continuous wetting, with a consequent increase in the maintenance cost of the machine, a lowering of the adhesion of the antisticky coating to the metal core of the roll.

SUMMARY OF THE INVENTION

It is therefore an object of the present invention to provide a silicone oil dispensing device for the heating rolls fixing unit of a copying machine in which the quantity of oil consumed for each copy produced is highly reduced, the life of the antisticky coating of the rolls is increased while prevention of the off-set phenomena is efficently maintained.

In accordance with the invention, there is provided in a heat fixing unit of a copy-machine of the type having a pair of cooperating fixing rolls at least one of which is heated to a suitable fixing temperature and through which a copy-sheet having an unfixed toner image is advanced, a toner antisticky liquid supply device comprising a tank for the liquid, a supply element movable between a first position in which it receives a small quantity of the liquid from the tank and a second position in which it contacts one of the fixing rolls to apply to it the received liquid, first means for cyclically moving the supply element between its first and second positions actuated at least once for each copy-run of the copy-machine, one of the fixing rolls being movable between an operative position in which it engages the other fixing roll and an inoperative position in which it is disengaged from the other fixing roll, and second means for moving the movable fixing roll from its inoperative position to its operative position at the start of a copy-run and from its operative position to its inoperative position at the end of a copy-run.

In preferred embodiments, the supply element has an intermediate rest position between its first and second positions; means are provided for actuating the first moving means to reciprocate the supply element between its rest position and its first position at the start of each copy cycle, and to reciprocate such supply element between its rest position and its second position at the end of each copy-run; the first named moving means includes a first cam selectively rotated by the actuating means and a cam follower connected to the supply element; the actuating means rotates the first cam by 180° at the beginning and at the end of a copy-run; the supply element comprises a rubber roll and the device further includes a felt, partially immersed in the liquid of the tank, filled with liquid by capillary action, the rubber roll being in contact with the felt when in its first position; the heated fixing roll contacted by the toned side of the copy-sheet is covered by an outer layer of tetrafluoroethylene and the other fixing roll has an outer coating of silicone rubber; the said second moving means includes a second cam and a second cam follower connected to the movable fixing roll; the said first and second cams are rigidly connected to and contemporaneously rotated by the actuating means; the fixing roll covered by a layer of silicone rubber has a diameter greater than the other fixing roll, whereby the life of the silicone rubber covering is increased; a heating lamp is mounted within the fixing roll contacting the toned side of the copy-sheet; and at least one metallic roll is mounted so as to engage the fixing roll having the heating lamp for equally distributing the thermal energy on the outer surface of such fixing roll.

BRIEF DESCRIPTION OF THE DRAWING

This and other objects of the present invention will be clear from the following description, made by way of example, with reference to the accompanying drawing showing a partially sectioned front view of a heating rolls fixing unit according to the invention.

DESCRIPTION OF THE PREFERRED EMBODIMENT

The fixing unit of the drawing is mounted on a copying machine of the type described in the U.S. Pat. application Ser. No. 757,537 filed on Jan. 7, 1977, now U.S. Pat. No. 4,129,378, of which a portion of the side frame 10 is visible in the drawing.

The fixing unit comprises a metallic roll 11, keyed on a motor shaft 13 and having its outer lateral surface coated by a layer of tetrafluoroethylene 12, and a metallic counter roll 14 having its outer surface coated by a layer of silicone rubber 15 and having within its metallic core a heating lamp 16. The counter roll 14 is keyed on a shaft 17 which is rotatably mounted on supporting levers 18 fulcrumed on a pin 19 of the machine frame.

Two cleaning rolls 20 and 21, made by chromed aluminum and respectively chromed steel, are rotatably mounted on pins 23 and 24, respectively.

The pins 23 and 24 are supported in slots 25 and 26, respectively, of the side levers 18, and are urged by springs 28 and 29, respectively, against the counter-roll 14 by which the rolls 20 and 21 are rotated.

The side levers 18 cooperate with a cam 30 rotatably mounted on a motor shaft 31 which is supported for counter clockwise on side frame 10 of the copy machine.

The shaft 31 selectively transmits its rotational motion to the cam 30 by a clutch device 34 of known type, controlled by an electromagnet 35 through a lever 36 fulcrumed on a pin 38 and having two arms 40 and 41 suitable to cooperate with the clutch tooth 43 for selectively maintain it in one of two positions angularly spaced by 180°.

A spring 45 maintains the arm 40 engaged with the tooth 43 when the electromagnet 35 is deenergized. Each energization of the electromagnet causes rotation of 180° of the cam 30. A spring 49 urges the side levers 18 in clockwise rotation, in the direction of contact between the counter roll 14 and the roll 11.

When the cam 30 is in the position shown in the drawing the counter roll 14 is held out of cooperative engagement with the roll 11, while counter clockwise rotation of the cam 30 through 180° causes cooperative engagement between the two rolls 14 and 11.

According to the present invention, a silicone oil dispensing device for wetting the surface of the rolls 11 and 14 is positioned under the roll 11. It comprises a tank 50 for the silicone oil, a felt 55 mounted on a dripping element 56 of the tank and partially immersed in the tank 50, whereby it is wet by capillary action and an oil supply roll 57, made of rubber and rotatably mounted on a pin 58 which is supported at one end 59 of two rocking levers 60 (only one of which is shown) fulcrumed at 61. The opposite ends 62 of the levers 60 cooperate through a cam follower roll 63, with a cam 65 which is secured to the cam 30 and therefore is rotatably mounted on the shaft 31.

When the cam 65 is in the position shown in the drawing the oil supply roll 57 is held in an intermediate position, shown by full line in the drawing, between the felt 55 and the roll 11. By a 180° counter clockwise rotation of the cam 65 starting from the position shown in the drawing, the oil supply roll 57 is moved from the intermediate position to a first position, shown by dashed line in the drawing, in which it contacts the felt 55 and receives on its surface a small quantity of silicone oil, and successively it is returned to the intermediate position. By a further 180° counter clockwise rotation of the cam 65, the roll 57 is moved from the intermediate position to a second position, shown by dash-dot line in the drawing, in which it contacts the fixing roll 11 whereby it is rotated, so transferring to the roll 11 the silicone oil, and then it is returned to its intermediate position.

A spring 70 engaging lever 60 holds the roll 57 in contact with the roll 11 during the entire time in which, due to the profile of the cam 65, the cam follower 63 is disengaged from the cam 65.

When the copy-machine is not operating, i.e. when it is switched on but a copy run is not started, the counter roll 14 is out of contact with the roll 11, the heating lamp 16 is switched off, the roll 57 is in its intermediate position, the roll 11 is counter clockwise rotated, and the cams 30 and 65 are stationary in the position shown in the drawing.

When a copy run is started by setting the key PRINT of the machine, the switch 80 is turned on, and through the energizing circuit 81, the electromagnet 35 is energized.

The cams 30 and 65 are consequently rotated 180° counter clockwise and the roll 14 is brought into contact with the roll 11 and is rotated by the roll 11.

Contemporarily the roll 57 draws a small quantity of oil from the felt 55 and thereafter returns to its intermediate position. The start of the copy run further causes the switching on of the heating lamp 16, whereby the rolls 11 and 14 reach their operative temperature (about 165° C. for the roll 14 and 150° C. for the roll 11).

During the execution of the copy-run, each copy-sheet 90 is advanced through the rolls 11 and 14, with the toner-imaged side face up and in contact with the roll 14, and the toned image 91 is fused on the sheet 90.

At the end of the execution of the copy-run, the switch 80 is turned off and the electromagnet 35 is deenergized, whereby the cams 30 and 65 are again rotated 180° counter clockwise, returning to the position shown in the drawing.

Consequently, the counter roll 14 is removed from contact with the roll 11, the oil wetting the outer coating 12, and then the roll 57 is returned to its intermediate position shown in the drawing. Turning off of the switch 80 further causes switching off of the heating lamp 16.

At the start of a successive copy-run the oil will be partially transferred from the roll 11 to the counter-roll 14.

According to the invention, the tasks of the cleaning rolls 20 and 21 are advance cleaning of adhering toner from the coating 15 and distribution of temperature uniformly on the surface of the coating 15 by acting as a thermal energy storage-dispenser.

With the oil supply device and the coating materials described during each copy-run about 10 mg of silicone oil is supplied to the fusing rolls 11 and 14.

From tests made by the applicant, it appears that such oil quantity is sufficient for one hundred copies and that the oil consumption is in the order of 0.5 kg per 100,000 copies.

According to a first modification to the fixing unit described, in order to reduce the wear of the coating 15 of the counter roll 14, the diameter of the counter roll 14 can be greater than that of the roll 11, so increasing the coating surface and correspondingly reducing the wear stress on a same portion of said surface.

According to a further modification to the fixing unit of the present invention, the drawing-supply operations of the supply roll 57 can be executed in a single cycle by disconnecting the cam 65 from the cam 30 and by driving the cam 65 through a 360° rotation at the beginning of each copy-run by a suitable clutch device.

It is to be understood that this and other modifications, additions, deletions to the fixing unit herein described can be made without departing from the spirit and the scope of the invention as claimed in the appended claims.

I claim:

1. In a heat fixing unit of a cyclically operating copy-machine of the type having a pair of cooperating fixing rolls at least one of which is heated to a suitable fixing temperature and through which a copy-sheet having an unfixed toner image is advanced, and actuating means controlling at least one copy cycle for each copy run, the improvement which comprises a toner antisticky liquid supply device including:

a tank for said liquid, a supply element selectively movable from a rest position to a first position, in which it receives a small quantity of said liquid from said tank, and to a second position in which it contacts one of said fixing rolls to apply to it the received liquid, first moving means for reciprocating said supply element between said rest position and said first position at the end of a copy-run and for reciprocating said supply element between said rest position and said second position at the start of a copy-run, one of said fixing rolls being movable between an operative position in which it engages the other fixing roll and an inoperative position in which it is disengaged from the other fixing roll, and second moving means for moving said movable fixing roll from said inoperative position to said operative position at the start of a copy-run and from said operative position to said inoperative position at the end of a copy-run.

2. The combination of claim 1 in which said first moving means includes a first cam selectively rotated by said actuating means and a cam follower connected to said supply element.

3. The combination of claim 2 in which said actuating means rotate said cam by 180° the beginning and at the end of copy-run.

4. The combination of claim 2 in which said second moving means includes a second cam bodily movable with said first cam and a second cam follower connected to said movable fixing roll.

5. The combination of claim 1 in which said supply element is a rubber roll and further comprising a felt partially immersed in the liquid of said tank and filled with liquid by capillary action, said rubber roll contacting said felt when in said first position.

6. The combination of claim 1 in which the heated fixing roll contacted by the toned side of the copy sheet is covered by an outer layer of tetrafluoroethylene and the other fixing roll has an outer coating of silicone rubber.

7. The combination of claim 6 in which the fixing roll covered by a layer of silicone rubber has a diameter greater than the other fixing roll, whereby the life of the silicon rubber covering is increased.

8. The combination of claim 1 further comprising a heating lamp mounted within the fixing roll contacting the toned side of the copy-sheet, and at least one metallic roll cooperating with said fixing roll for uniformly distributing the temperature.

* * * * *